US008862012B2

(12) United States Patent
Takiguchi

(10) Patent No.: US 8,862,012 B2
(45) Date of Patent: Oct. 14, 2014

(54) IMAGE FORMING APPARATUS, POWER SUPPLYING METHOD, AND COMPUTER-READABLE STORAGE MEDIUM

(75) Inventor: Akira Takiguchi, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 180 days.

(21) Appl. No.: 13/449,752

(22) Filed: Apr. 18, 2012

(65) Prior Publication Data

US 2012/0275812 A1 Nov. 1, 2012

(30) Foreign Application Priority Data

Apr. 26, 2011 (JP) ..... 2011-098081

(51) Int. Cl.
*G03G 15/00* (2006.01)

(52) U.S. Cl.
CPC ..... *G03G 15/5004* (2013.01)
USPC ..... 399/88

(58) Field of Classification Search
CPC ..... G03G 2215/00983; G03G 15/5004
USPC ..... 399/37, 88
See application file for complete search history.

(56) References Cited

U.S. PATENT DOCUMENTS 4,533,972 A * 8/1985 Ohashi ..... 361/156
5,950,037 A * 9/1999 Ko ..... 399/38
6,330,069 B1 * 12/2001 Kim ..... 358/1.14
2006/0285867 A1 * 12/2006 Takahashi et al. ..... 399/70

FOREIGN PATENT DOCUMENTS

JP 7-199739 8/1995
JP 2008-233263 10/2008

* cited by examiner

*Primary Examiner* — Gregory H Curran
(74) *Attorney, Agent, or Firm* — Oblon, Spivak, McClelland, Maier & Neustadt, L.L.P.

(57) ABSTRACT

An image forming apparatus includes a first control unit configured to control an image forming unit; a power supply unit configured to supply power from a commercial power source; a switching unit configured to switch a connection state between the power supply unit and the commercial power source from a conduction state to a non-conduction state, or vice versa; a capacitor configured to store therein power used by the switching unit; a second control unit configured to detect a start signal for starting power supply from the power supply unit; and a battery for supplying power to the second control unit. The power supply unit supplies power to the first control unit in the conduction state and stops the power supply in the non-conduction state. When detecting the start signal, the second control unit causes the switching unit to switch the connection state to the conduction state.

10 Claims, 8 Drawing Sheets

5/8

IMAGE FORMING APPARATUS, POWER SUPPLYING METHOD, AND COMPUTER-READABLE STORAGE MEDIUM

CROSS-REFERENCE TO RELATED APPLICATIONS

The present application claims priority to and incorporates by reference the entire contents of Japanese Patent Application No. 2011-098081 filed in Japan on Apr. 26, 2011.

BACKGROUND OF THE INVENTION

1. Field of the Invention

The present invention relates to an image forming apparatus, a power supplying method, and computer-readable storage medium.

2. Description of the Related Art

Conventionally, there is a known image forming apparatus that, when printing is suspended, stops power supply from a commercial power source but continuously operates a circuit for detecting a printing execution instruction by supplying power to the circuit from a power source separate from the commercial power source. For example, Japanese Patent Application Laid-open No. H7-199739 discloses an image forming apparatus provided with a starting circuit that operates to detect a printing execution instruction by receiving power from a battery. In the image forming apparatus disclosed in Japanese Patent Application Laid-open No. H7-199739, during a sleep mode in which printing is suspended, a relay interposed between a commercial power source and a power supply unit that supplies power from the commercial power source is switched to the off-state to stop power supply from the commercial power source, but the starting circuit is continuously operated. In this state, when the starting circuit detects a printing execution instruction, the relay is switched to the on-state. Accordingly, power supply from the commercial power source is resumed, so that an image forming unit that forms an image on a medium is activated to perform printing.

However, in the technology disclosed in Japanese Patent Application Laid-open No. H7-199739, while the relay is operated by using power charged in the battery, if the discharge efficiency (the discharge loss) of the battery is taken into account, it is necessary to charge the battery with a much greater amount of power than the amount of power needed to operate the relay. Therefore, it is difficult to sufficiently reduce the power consumption of the image forming apparatus.

Therefore, there is a need for an image forming apparatus capable of reducing the power consumption.

SUMMARY OF THE INVENTION

It is an object of the present invention to at least partially solve the problems in the conventional technology.

According to an embodiment, there is provided an image forming apparatus that includes an image forming unit configured to form an image on a medium; a first control unit configured to control the image forming unit; a power supply unit configured to supply power from a commercial power source; a switching unit configured to switch a connection state between the power supply unit and the commercial power source from a conduction state to a non-conduction state, or vice versa; a capacitor configured to store therein power used by the switching unit; a second control unit configured to detect whether to receive a start signal indicating a request to start power supply from the power supply unit and to control the switching unit; and a battery configured to supply power to the second control unit. The power supply unit supplies power to the first control unit in the conduction state and stops power supply to the first control unit in the non-conduction state, and when detecting that the start signal is received, the second control unit causes the switching unit to switch the connection state to the conduction state.

According to another embodiment, there is provided a method for supplying power to an image forming apparatus that includes an image forming unit configured to form an image on a medium, a first control unit configured to control the image forming unit, a power supply unit configured to supply power from a commercial power source, a switching unit configured to switch a connection state between the power supply unit and the commercial power source from a conduction state to a non-conduction state, or vice versa, a capacitor configured to store therein power used by the switching unit, a second control unit configured control the switching unit, and a battery configured to supply power to the second control unit. The method includes detecting, by the second control unit, whether to receive a start signal indicating a request to start power supply from the power supply unit or a stop signal indicating a request to stop power supply from the power supply unit; switching, by the second control unit, the connection state to the conduction state so that the power is supplied to the first control unit when detecting that the start signal is received; and switching, by the second control unit, the connection state to the non-conduction state so that the power is not supplied to the first control unit when detecting that the stop signal is received.

According to still another embodiment, there is provided a non-transitory computer-readable storage medium with an executable program stored thereon for controlling an image forming apparatus that includes an image forming unit configured to form an image on a medium, a first control unit configured to control the image forming unit, a power supply unit configured to supply power from a commercial power source, a switching unit configured to switch a connection state between the power supply unit and the commercial power source from a conduction state to a non-conduction state, or vice versa, a capacitor configured to store therein power used by the switching unit, a second control unit configured control the switching unit, and a battery configured to supply power to the second control unit. The program instructs a computer as the second control unit to perform detecting whether to receive a start signal indicating a request to start power supply from the power supply unit or a stop signal indicating a request to stop power supply from the power supply unit; switching the connection state to the conduction state so that the power is supplied to the first control unit when detecting that the start signal is received; and switching the connection state to the non-conduction state so that the power is not supplied to the first control unit when detecting that the stop signal is received.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 2 is a flowchart of an operation example of a process performed by the image forming apparatus when a main power switch is turned on;

DETAILED DESCRIPTION OF THE PREFERRED EMBODIMENTS

Exemplary embodiments of the present invention will be explained in detail below with reference to the accompanying drawings. In the following embodiments, a multifunction peripheral having at least a copying function, a printing function, a scanning function, or a facsimile function is explained as an example of an image forming apparatus; however, the present invention is not limited thereto.

First Embodiment

Figure 1:
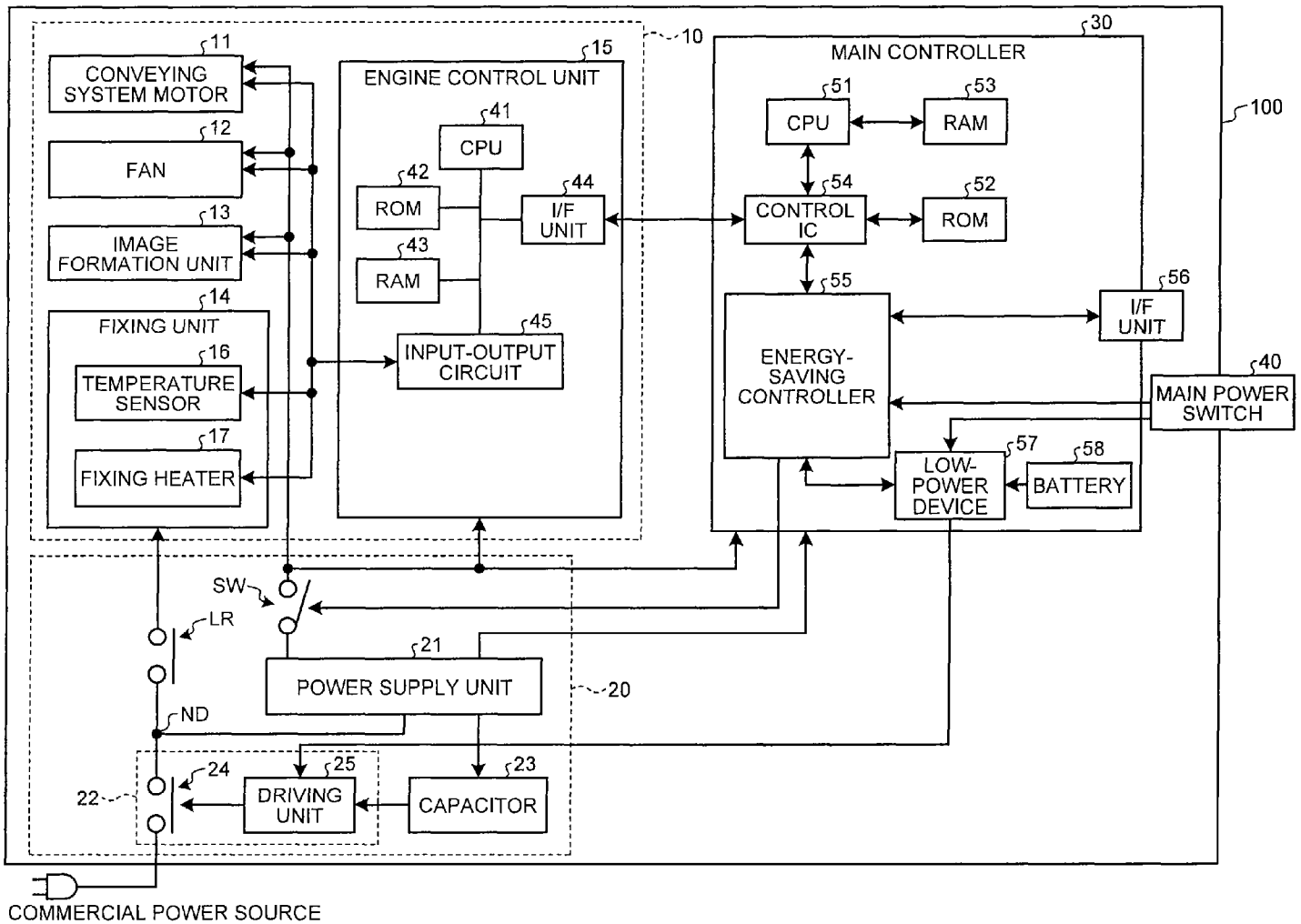
FIG. 1 is a block diagram of a configuration example of an image forming apparatus according to a first embodiment.

FIG. 1 is a diagram illustrating a schematic configuration example of an image forming apparatus 100 according to a first embodiment. As illustrated in FIG. 1, the image forming apparatus 100 includes an image forming unit 10, a power source unit 20, a main controller 30, and a main power switch 40.

The image forming unit 10 forms an image on a medium, such a sheet of paper, under the control of the main controller 30. As illustrated in FIG. 1, the image forming unit 10 includes a conveying system motor 11, a fan 12, an image formation unit 13, a fixing unit 14, and an engine control unit 15. The conveying system motor 11 drives a device (for example, a conveying roller) in a conveying system. The fan 12 is a means for suppressing an increase in the temperature inside the image forming apparatus. The image formation unit 13 transfers a toner image (a visualized electrostatic latent image) formed on a photosensitive drum (not illustrated) onto a medium, such as a sheet of paper. The fixing unit 14 fixes the toner image on the medium, such as a sheet of paper. The fixing unit 14 includes a temperature sensor 16 and a fixing heater 17. The temperature sensor 16 detects the temperature of a fixing roller (not illustrated). The fixing heater 17 heats the fixing roller.

The engine control unit 15 controls an image forming operation (a printing operation) performed by the image forming unit 10. As illustrated in FIG. 1, the engine control unit 15 is a computer that includes a central processing unit (CPU) 41, a read only memory (ROM) 42, a random access memory (RAM) 43, an interface (I/F) unit 44, and an input-output circuit 45. The CPU 41 controls the units (the conveying system motor 11, the fan 12, the image formation unit 13, the fixing unit 14, and the engine control unit 15) of the image forming unit 10 by executing a predetermined control program stored in the ROM 42 or the like. The ROM 42 is a nonvolatile semiconductor memory for storing the control program or various types of data. The RAM 43 is a volatile semiconductor memory for temporarily storing various types of data when various programs stored in the ROM 42 are executed. The I/F unit 44 is a means for connecting the engine control unit 15 to the main controller 30. The input-output circuit 45 performs a signal input-output process with the conveying system motor 11, the fan 12, the image formation unit 13, and the fixing unit 14.

As illustrated in FIG. 1, the power source unit 20 includes a power supply unit (PSU) 21, a switching unit 22, and a capacitor 23. The PSU 21 supplies power from a commercial power source (an alternating-current (AC) power source). In the present embodiment, the PSU 21 converts an alternating-current voltage supplied from the commercial power source to a direct-current voltage that is applicable to the main controller 30 and the image forming unit 10. The switching unit 22 switches a connection state between the PSU 21 and the commercial power source from a conduction state to a non-conduction state, or vice versa. The switching unit 22 includes a relay 24 and a driving unit that operates the relay 24. In the first embodiment, the relay 24 is configured as a latch solenoid relay; however, it is not limited thereto. When the relay 24 is switched to the on-state, the connection state between the PSU 21 and the commercial power source enters the conduction state. On the other hand, when the relay 24 is switched to the off-state, the connection state between the PSU 21 and the commercial power source enters the non-conduction state. A driving unit 25 operates the relay 24 under the control of the main controller 30 (a low-power device 57 to be described later). The capacitor 23 stores therein power used by the switching unit 22. For example, when switching the relay 24 to the on-state, the driving unit 25 applies power stored in the capacitor 23 to a solenoid (not illustrated). Accordingly, the solenoid is excited and thus the relay 24 is switched to the on-state.

In the present embodiment, when the connection state between the PSU 21 and the commercial power source is switched to the conduction state (when the relay 24 is switched to the on-state), power from the PSU 21 is supplied to the main controller 30 and the capacitor 23. In this case, power is supplied to some of the units of the main controller 30, and more particularly, to at least a CPU 51 and an energy-saving controller 55. In the state (the initial state) before the image forming apparatus 100 starts to be used, the value of the voltage stored in the capacitor 23 is set to be equal to or greater than the value of the voltage that is needed to switch the relay 24 to the on-state.

In the present embodiment, as illustrated in FIG. 1, a switch SW that is turned on or off under the control of the main controller 30 is provided between the PSU 21 and the main controller 30 or the image forming unit 10. When the switch SW is in the on-state, power from the PSU 21 is supplied to the main controller 30 (to the units that are not supplied with power when the relay 24 is switched to the on-state), the engine control unit 15, the conveying system motor 11, the fan 12, and the image formation unit 13. On the other hand, when the switch SW is in the off-state, power from the PSU 21 is not supplied to the main controller 30 (the units that are not supplied with power when the relay 24 is switched to the on-state), the engine control unit 15, the conveying system motor 11, the fan 12, and the image formation unit 13.

Furthermore, as illustrated in FIG. 1, in the present embodiment, a relay LR that is turned on or off under the control of the main controller 30 is provided between the fixing unit 14 and a node ND that is interposed in a power supply pathway from the relay 24 to the PSU 21. When the relay 24 and the relay LR are in the on-states, power from the commercial power source is supplied to the fixing unit 14. On the other hand, when at least one of the relay 24 and the relay LR is in the off-state, power from the commercial power source is not supplied to the fixing unit 14.

The main controller 30 is a means for controlling the entire image forming apparatus 100. As illustrated in FIG. 1, the main controller 30 includes the CPU 51, a ROM 52, a RAM 53, a control integrated circuit (IC) 54, the energy-saving controller 55, an I/F unit 56, the low-power device 57, and a battery 58.

The CPU 51 controls the image forming unit 10, the power source unit 20, and the main controller 30 by executing a predetermined control program stored in the ROM 52 or the like. The ROM 52 is a nonvolatile semiconductor memory for storing the control program or various types of data. The RAM 53 is a volatile semiconductor memory for temporarily storing various types of data when various programs stored in the ROM 52 are executed.

The control IC 54 functions as a bridge for connecting the CPU 51, the ROM 52, the energy-saving controller 55, and the I/F unit 44 of the engine control unit 15 to one another. In the example in FIG. 1, the RAM 53 is connected to the CPU 51. The energy-saving controller 55 is a computer that includes a CPU that differs from the CPU 51, and performs, for example, an energy-saving control process for setting the operating state of the image forming apparatus 100 to an energy-saving mode. The energy-saving mode in the present embodiment is a state in which power is supplied to only the main controller 30. In the energy-saving mode, the energy-saving controller 55 causes the switching unit 22 to enter the on-state and causes the switch SW and the relay LR to enter the off-states, in cooperation with the CPU 51 and the low-power device 57.

The I/F unit 56 is an interface for connecting the main controller 30 to an external apparatus (for example, a facsimile machine). The low-power device 57 detects whether to receive a start signal indicating a request to start power supply from the PSU 21, and controls the driving unit 25 of the power source unit 20. The battery 58 is a power source of the low-power device 57 and is configured as, for example, a primary battery.

The main power switch 40 is turned on or off by a user operation. The main power switch 40 outputs the start signal when the main power switch 40 is turned on, and outputs a stop signal indicating a request to stop power supply from the PSU 21 when the main power switch 40 is turned off. In the present embodiment, the main power switch 40 inputs the start signal to the low-power device 57 when the main power switch 40 is turned on, and inputs the stop signal to the energy-saving controller 55 when the main power switch 40 is turned off.

Figure 2:
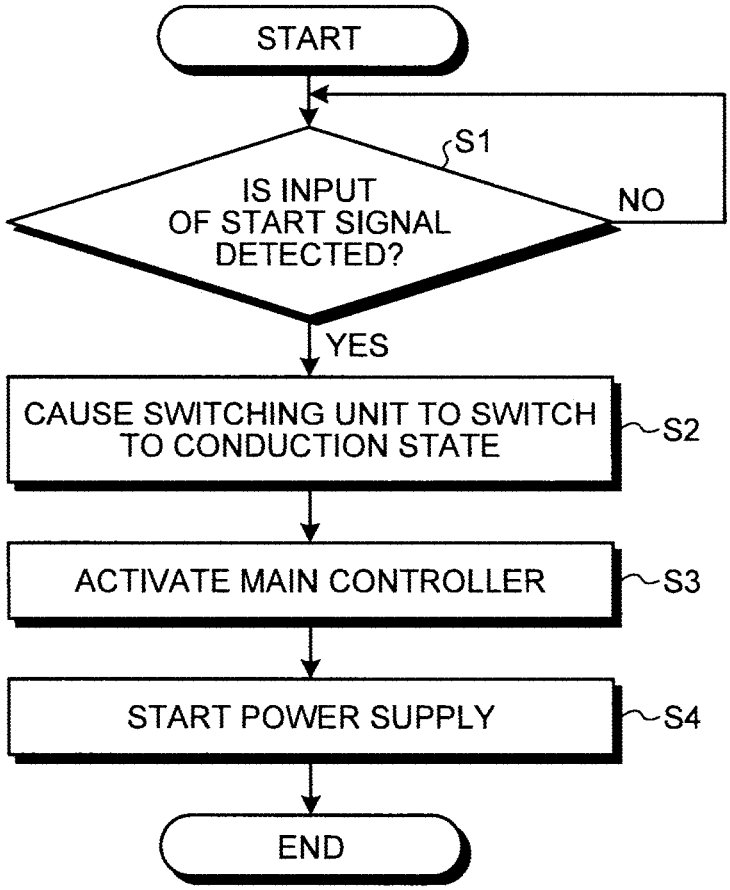

FIG. 2 is a flowchart of an operation example of a process performed by the image forming apparatus 100 when the main power switch 40 is turned on. As described above, the main power switch 40 inputs the start signal to the low-power device 57 when the main power switch 40 is turned on. When the low-power device 57 detects input of the start signal (YES at Step S1), the low-power device 57 causes the switching unit 22 to switch the connection state between the PSU 21 and the commercial power source to the conduction state (Step S2). Specifically, when detecting that the start signal is received, the low-power device 57 outputs an on-signal, which indicates an instruction to switch the relay 24 to the on-state, to the driving unit 25. When receiving the ON-signal, the driving unit 25 switches the relay 24 to the on-state. More specifically, the driving unit 25 applies the voltage stored in the capacitor 23 to the solenoid (not illustrated) to thereby switch the relay 24 to the on-state.

As described above, when the relay 24 is switched to the on-state, power from the PSU 21 is supplied to the main controller 30 and the capacitor 23. In other words, the main controller 30 is supplied with power and the capacitor 23 is charged. The main controller 30 is activated by receiving power from the PSU 21 (Step S3). The main controller 30 starts power supply to the other units (Step S4). More specifically, the main controller 30 switches the switch SW and the relay LR to the on-states. Accordingly, power supply to the image forming unit 10 and the main controller 30 (the units that are not supplied with power even when the relay 24 is switched to the on-state) is started.

Figure 3:
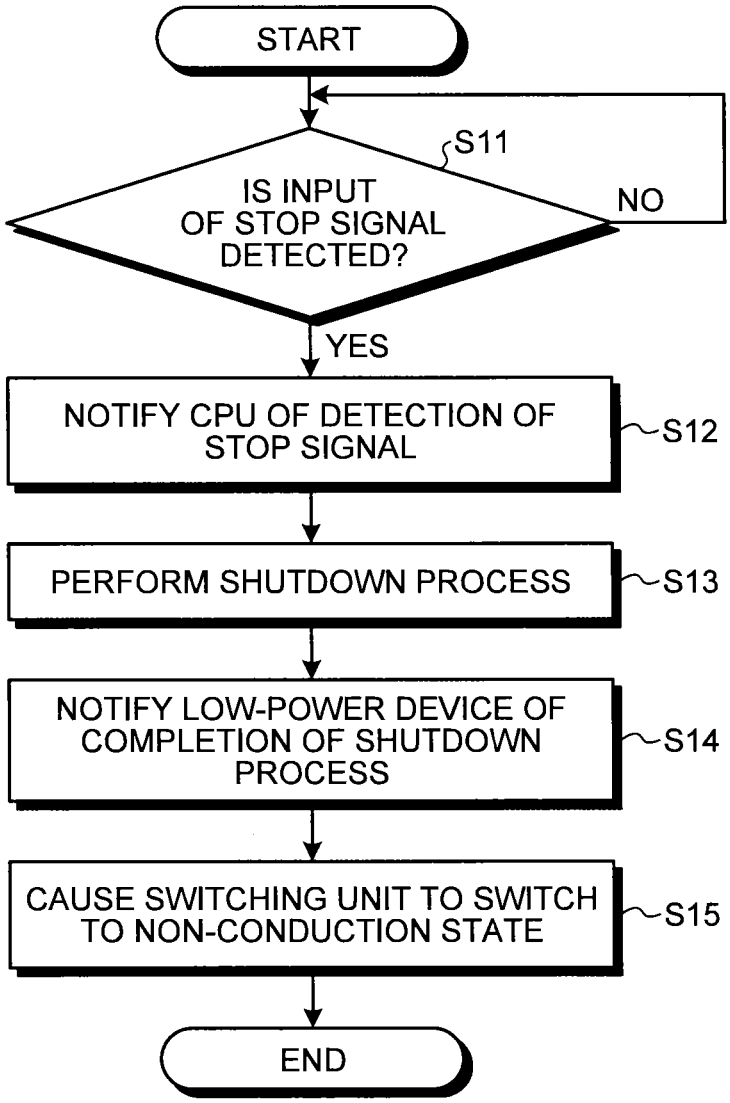
FIG. 3 is a flowchart of an operation example of a process performed by the image forming apparatus when the main power switch is turned off.

FIG. 3 is a flowchart of an operation example of a process performed by the image forming apparatus 100 when the main power switch 40 is turned off. As described above, the main power switch 40 inputs the stop signal to the energy-saving controller 55 when the main power switch 40 is turned off. When the energy-saving controller 55 detects input of the stop signal (YES at Step S11), the energy-saving controller 55 sends, to the CPU 51, a notice indicating that the stop signal is input (Step S12). When receiving the notice, the CPU 51 performs a shutdown process (Step S13). Specifically, the CPU 51 switches the switch SW and the relay LR to the off-state to stop power supply to the image forming unit 10 and the main controller 30. The CPU 51 saves (stores) various data. In the present embodiment, the stop signal is input to the energy-saving controller 55; however, it is not limited thereto. For example, it may be possible to input the stop signal to the CPU 51 and cause the CPU 51 to perform the shutdown process when the CPU 51 detects input of the stop signal.

When the shutdown process at Step S13 is completed, the CPU 51 sends a notice of the completion of the shutdown process to the low-power device 57 via the energy-saving controller 55 (Step S14). When receiving the notice, the low-power device 57 causes the switching unit 22 to switch the connection state between the PSU 21 and the commercial power source to the non-conduction state (Step S15). Specifically, the low-power device 57 outputs an off-signal, which indicates an instruction to switch the relay 24 to the off-state, to the driving unit 25. More specifically, the driving unit 25 releases the excitation voltage that has been applied to the solenoid to thereby switch the relay 24 to the off-state.

Even when the relay 24 is switched to the off-state and the connection state between the PSU 21 and the commercial power source is switched to the non-conduction state, the low-power device 57 being supplied with power from the battery 58 continues to operate. In this state, when the low-power device 57 detects input of the start signal, the low-power device 57 causes the switching unit 22 to switch the connection state between the PSU 21 and the commercial power source to the conduction state.

As described above, when the low-power device 57 of the present embodiment detects that the start signal is received, the low-power device 57 causes the switching unit 22 to switch the connection state between the PSU 21 and the commercial power source to the conduction state. In this case, the driving unit 25 operates the relay 24 by using power stored in the capacitor 23, which has higher discharge efficiency (lower discharge loss) than that of a battery. Therefore, according to the present embodiment, it is advantageous in that the necessary amount of power can be reduced compared with the case that the relay 24 is operated by using power charged in an electrical accumulator, such as a battery.

Second Embodiment

Figure 4:
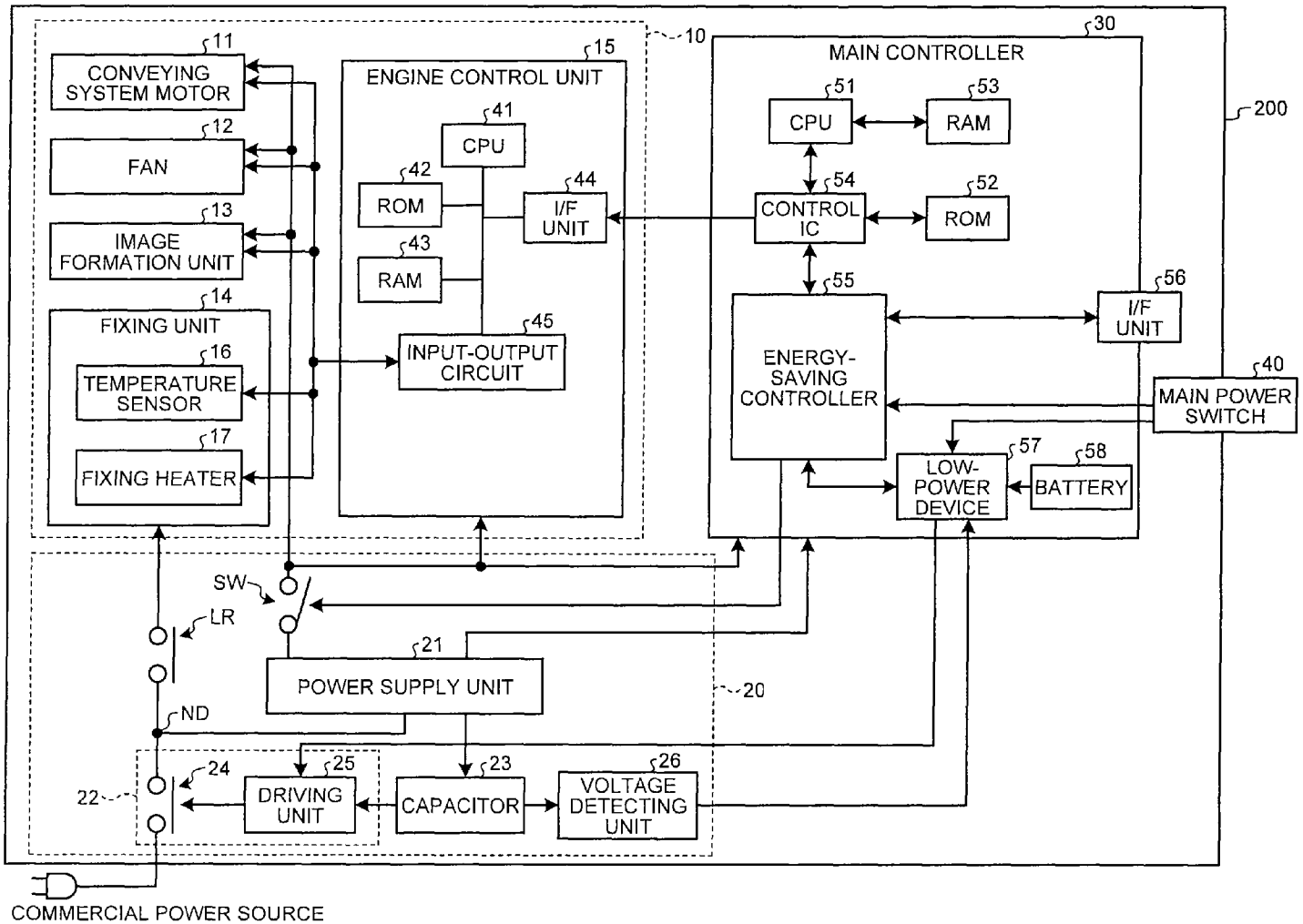
FIG. 4 is a block diagram of a configuration example of an image forming apparatus according to a second embodiment.

A second embodiment will be explained below. FIG. 4 is a diagram illustrating a hardware configuration example of an image forming apparatus 200 according to the second embodiment. As illustrated in FIG. 4, the image forming apparatus 200 of the present embodiment differs from the first embodiment in that the image forming apparatus 200 further includes a voltage detecting unit 26 that detects the voltage of the capacitor 23. A detailed explanation will be given below. The same components as those of the first embodiment are denoted by the same reference numerals and the same explanation will be omitted appropriately.

A voltage value of the capacitor 23 detected by the voltage detecting unit 26 is provided to the low-power device 57. When the voltage value of the capacitor 23 is smaller than a reference value while the connection state between the PSU 21 and the commercial power source is maintained in the non-conduction state, the low-power device 57 causes the switching unit 22 to switch the connection state between the PSU 21 and the commercial power source to the conduction state. Therefore, the capacitor 23 is charged with power from the PSU 21. It is sufficient that a voltage value used as the reference value is equal to or greater than the voltage value needed to switch the relay 24 to the on-state. On the other hand, when the voltage value of the capacitor 23 is equal to or greater than the reference value, the low-power device 57 causes the switching unit 22 to switch the connection state between the PSU 21 and the commercial power source to the non-conduction state.

According to the present embodiment, it is possible to maintain the voltage value of the capacitor 23 at or above the reference value. Therefore, it becomes possible to reliably switch the relay 24 to the on-state when the start signal is input. That is, it becomes possible to reliably switch the connection state between the PSU 21 and the commercial power source to the conduction state.

Third Embodiment

Figure 5:
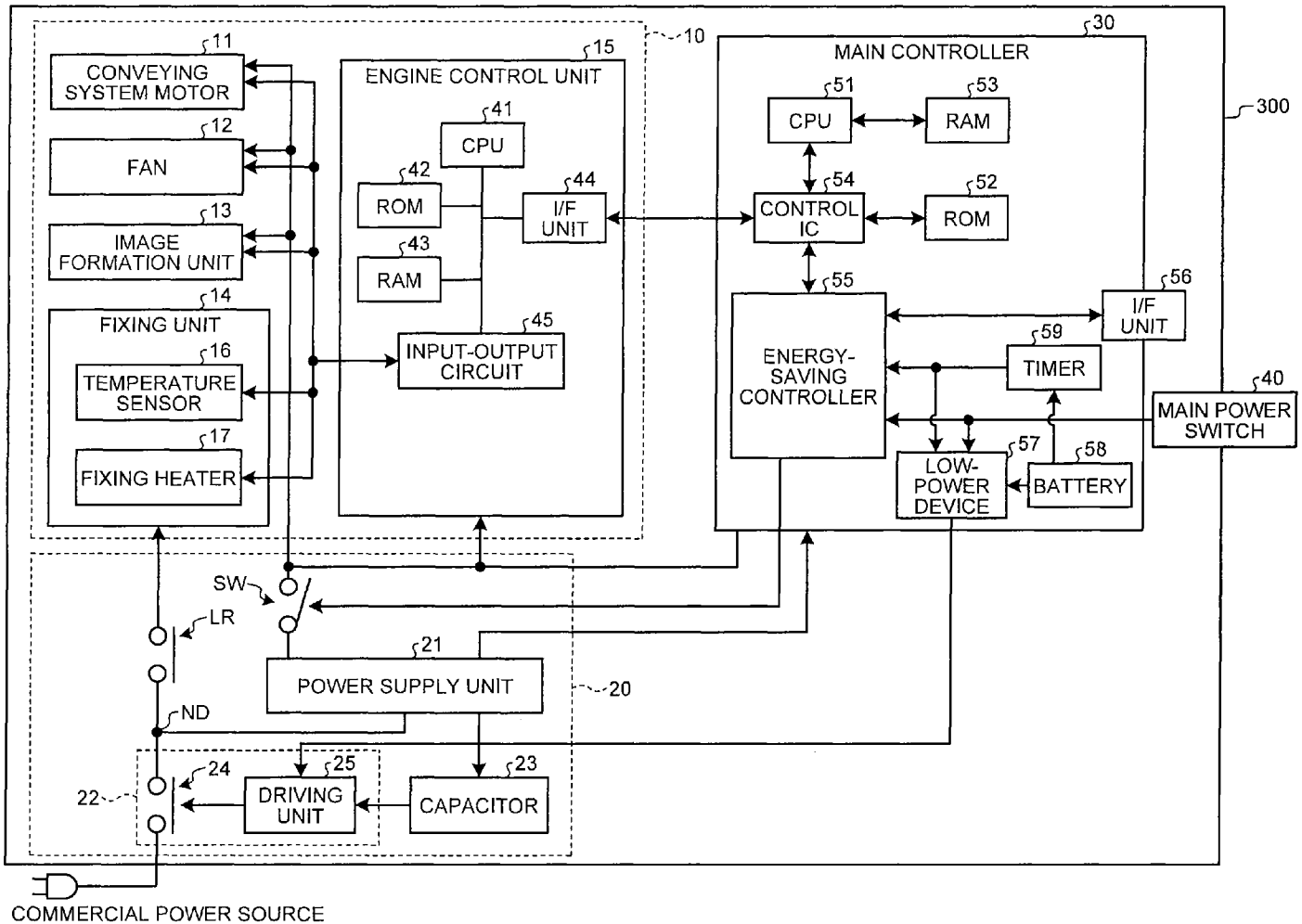
FIG. 5 is a block diagram of a configuration example of an image forming apparatus according to a third embodiment.

A third embodiment will be explained below. FIG. 5 is a diagram illustrating a hardware configuration example of an image forming apparatus 300 according to a third embodiment. As illustrated in FIG. 5, the image forming apparatus 300 of the present embodiment differs from the first embodiment in that the image forming apparatus 300 further includes a timer 59 and the relay 24 is automatically turned on or off according to the time indicated on the timer 59. The same components as those of the first embodiment are denoted by the same reference numerals and the same explanation will be omitted appropriately.

The timer 59 is a means for measuring a time. For example, the timer 59 may have a real-time clock function for measuring the current time. Similarly to the low-power device 57, the timer is supplied with power from the battery 58; therefore, the timer 59 can continue to operate even when the relay 24 is in the off-state.

In the present embodiment, when the timer 59 detects that a stop time, at which power supply from the PSU 21 is stopped, comes, the low-power device 57 causes the switching unit 22 to switch the connection state between the PSU 21 and the commercial power source to the non-conduction state. Specifically, when detecting that the stop time comes, the timer 59 sends stop information, which indicates that the stop time comes, to the energy-saving controller 55. The energy-saving controller 55 transfers the stop information received from the timer 59 to the CPU 51. When receiving the stop information, the CPU 51 performs the shutdown process as described above. When the shutdown process is completed, the CPU 51 sends a notice of the completion of the shutdown process to the low-power device 57 via the energy-saving controller 55. When receiving the notice, the low-power device 57 causes the driving unit 25 to switch the relay 24 to the off-state. In the present embodiment, it may be possible to regard the stop information provided by the timer 59 as the "stop signal" described in the first embodiment. The time used as the stop time and the way to set the time can be determined in any manner. In the present embodiment, the stop information (the stop signal) is input to the energy-saving controller 55; however, it is not limited thereto. For example, the stop information may be input to the CPU 51.

In the present embodiment, when the timer 59 detects that a start time at which power supply from the PSU 21 is started comes, the low-power device 57 causes the switching unit 22 to switch the connection state between the PSU 21 and the commercial power source to the conduction state. Specifically, when detecting that the start time comes, the timer 59 sends start information which indicates that the start time comes to the low-power device 57. When detecting input of the start information, the low-power device 57 causes the driving unit 25 to switch the relay 24 to the on-state. In the present embodiment, it may be possible to regard the start information as the "start signal" described in the first embodiment. The time used as the start time and the way to set the time can be determined in any manner.

Fourth Embodiment

Figure 6:
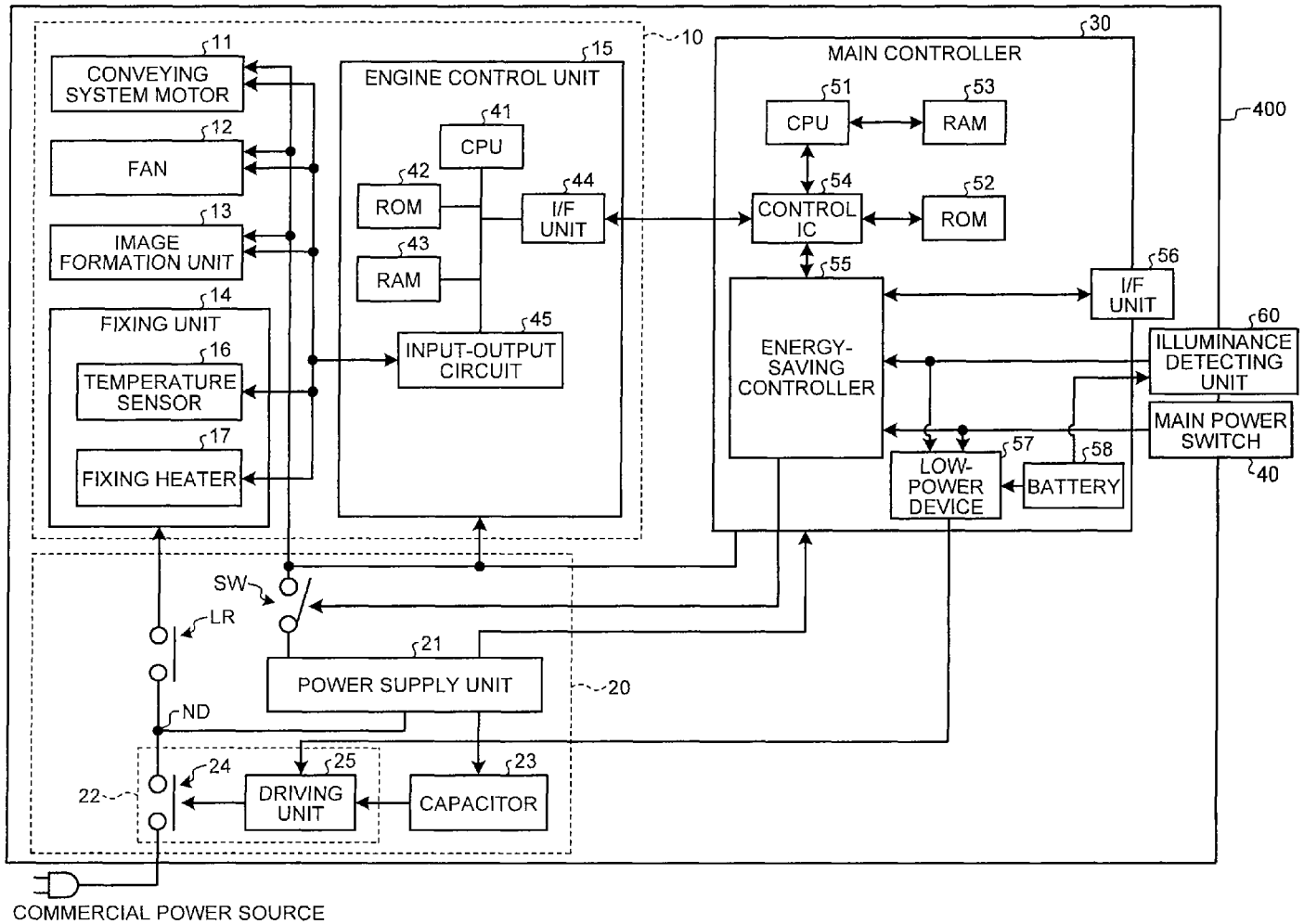
FIG. 6 is a block diagram of a configuration example of an image forming apparatus according to a fourth embodiment.

A fourth embodiment will be explained below. FIG. 6 is a diagram illustrating a hardware configuration example of an image forming apparatus 400 according to a fourth embodiment. As illustrated in FIG. 6, the image forming apparatus 400 of the present embodiment differs from the first embodiment in that the image forming apparatus 400 further includes an illuminance detecting unit 60 that detects the illuminance of the environment and the relay 24 is automatically turned on or off according to the illuminance of the environment. The same components as those of the first embodiment are denoted by the same reference numerals and the same explanation will be omitted appropriately.

The illuminance detecting unit 60 detects the illuminance of the environment. For example, the illuminance detecting unit 60 includes an optical sensor, such as a photodiode, for converting received light to an electrical signal, and includes a control unit, such as a microcomputer, for calculating the illuminance based on the signal detected by the optical sensor. Similarly to the low-power device 57, the illuminance detecting unit 60 is supplied with power from the battery 58; therefore, the illuminance detecting unit 60 can continue to operate even when the relay 24 is in the off-state.

In the present embodiment, when the illuminance of the environment is equal to or smaller than a predetermined value, the low-power device 57 causes the switching unit 22 to switch the connection state between the PSU 21 and the commercial power source to the non-conduction state. Specifically, when detecting that the illuminance of the environment is equal to or smaller than the predetermined value, the illuminance detecting unit 60 sends first information, which indicates that the illuminance of the environment is equal to or smaller than the predetermined value, to the energy-saving controller 55. The energy-saving controller 55 transfers the first information received from the illuminance detecting unit 60 to the CPU 51. When receiving the first information, the CPU 51 performs the shutdown process as described above. When the shutdown process is completed, the CPU 51 sends a notice of the completion of the shutdown process to the low-power device 57 via the energy-saving controller 55. When receiving the notice, the low-power device 57 causes the driving unit 25 to switch the relay 24 to the off-state. In the present embodiment, it may be possible to regard the first information provided by the illuminance detecting unit 60 as the "stop signal" described in the first embodiment. In the present embodiment, the first information (the stop signal) is input to the energy-saving controller 55; however, it is not limited thereto. For example, the first information may be input to the CPU 51.

In the present embodiment, when the illuminance of the environment exceeds the predetermined value, the low-power device 57 causes the switching unit 22 to switch the connection state between the PSU 21 and the commercial power source to the conduction state. Specifically, when determining that the illuminance of the environment exceeds the predetermined value, the illuminance detecting unit 60 sends second information, which indicates that the illuminance of the environment exceeds the predetermined value, to the low-power device 57. When detecting the input of the second information, the low-power device 57 causes the driving unit 25 to switch the relay 24 to the on-state. In the present embodiment, it may be possible to regard the second information provided by the illuminance detecting unit 60 as the "start signal" described in the first embodiment. The predetermined value and the way to setting the predetermined value can be determined in any manner.

Modification

Figure 7:
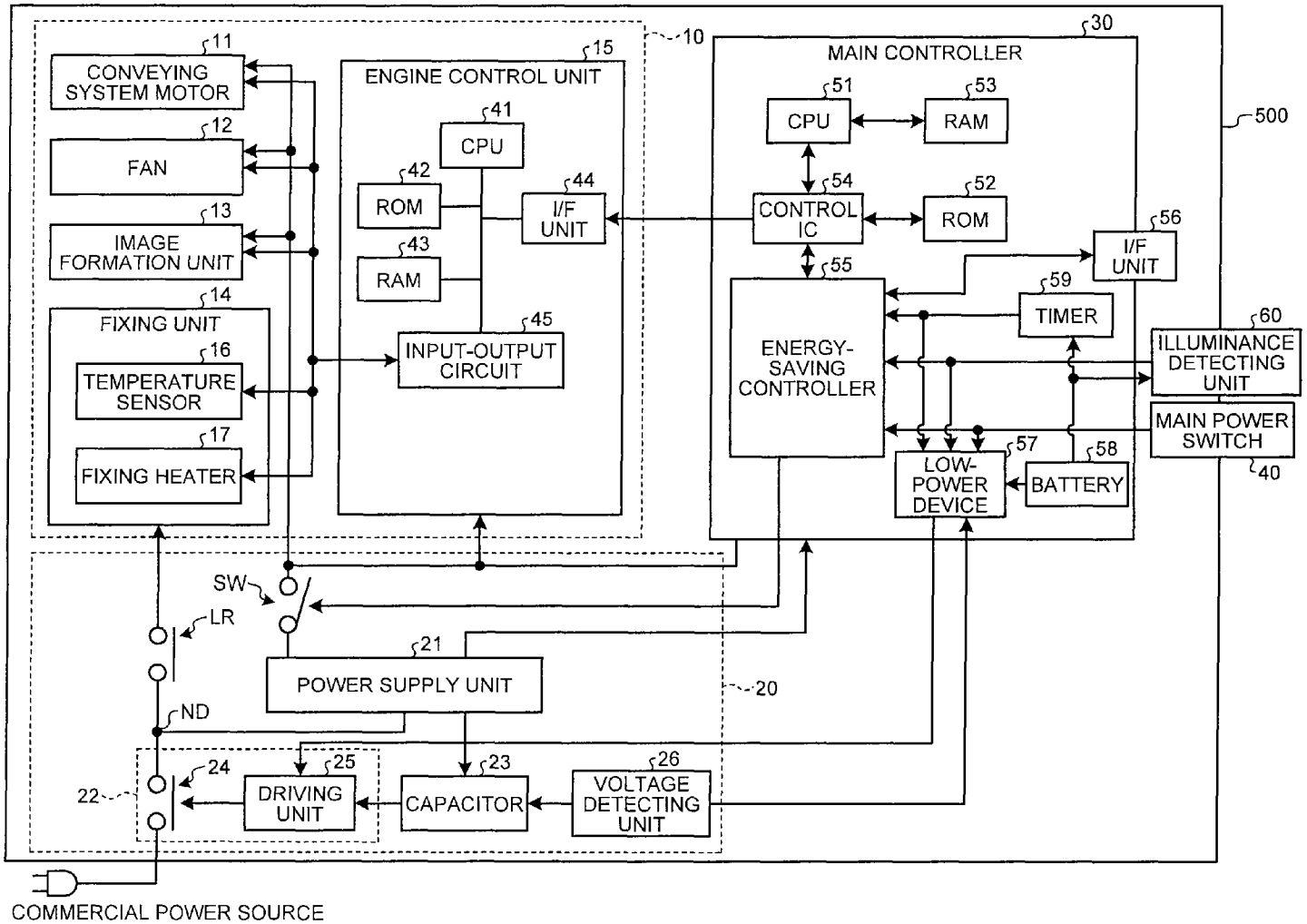
FIG. 7 is a block diagram of a configuration example of an image forming apparatus according to a modification.
Figure 8:
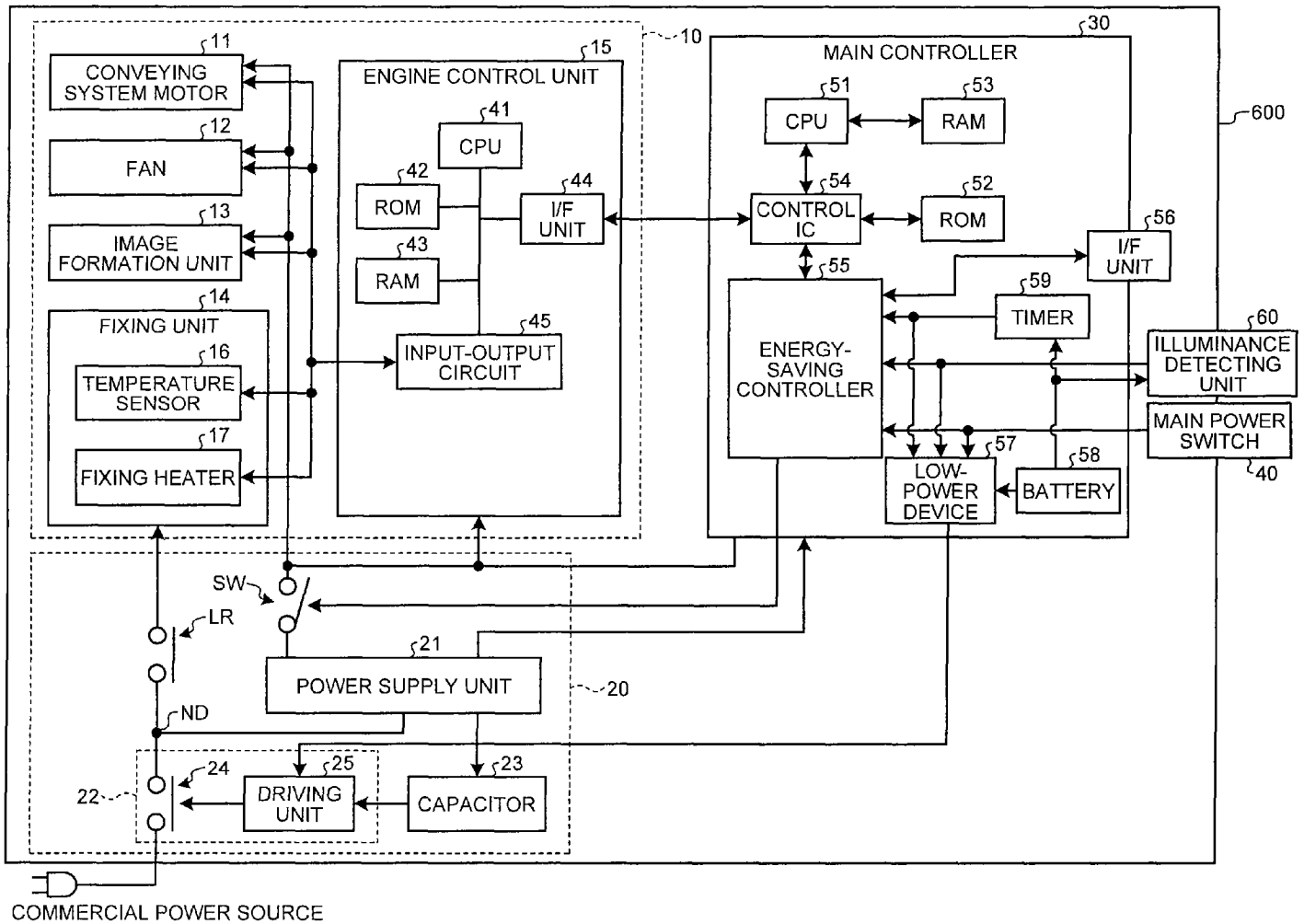
FIG. 8 is a block diagram of a configuration example of an image forming apparatus according to another modification.

The embodiments of the present invention have been explained above; however, the present invention is not limited to these embodiments and may be modified in various forms within the scope of the present invention. For example, any components in the above embodiments may be combined in any manner. For example, as illustrated in FIG. 7, an image forming apparatus 500 may be configured to combine the configurations of the second to the fourth embodiments. In the image forming apparatus 500 in FIG. 7, it may be possible to allow a user to select a mode in which the relay 24 is switched to the on-state or the off-state depending on the on-off state of the main power switch 40, a mode in which the relay 24 is automatically switched to the on-state or the off-state according to the time indicated on the timer 59, or a mode in which the relay 24 is automatically switched to the on-state or the off-state depending on the illuminance of the environment detected by the illuminance detecting unit 60. Furthermore, as illustrated in FIG. 8, an image forming apparatus 600 may be configured to combine the configurations of the third and the fourth embodiments.

The start signal described above may be of any type. In other words, any signal that indicates a request to start power supply from the PSU 21 may be used. Any event may be a cause to input the start signal, and the event is not limited to the operation of turning the main power switch 40 on or off, a time, and the illuminance of the environment. For example, the start signal may be input by an external apparatus that is separate from the image forming apparatus at a timing designated by a user of the external apparatus. The same is applied to the stop signal.

In the above embodiments, the low-power device 57 is included in the main controller 30; however, it is not limited thereto. For example, the low-power device 57 may be provided independent of the main controller 30. In the above embodiments, the low-power device 57 can be referred to as "a second control unit". In other words, the second control unit may be any unit that can continue to operate by being supplied with power from the battery 58 even when power supply from the PSU 21 is stopped, that detects whether to receive the start signal, and that controls the switching unit 22.

It may be possible to remove the switch SW and the relay LR described above. In this configuration, when the relay 24 is switched to the on-state, power is supplied to all the units that need to be supplied with power (for example, the image forming unit 10 and the main controller 30). In other words, it may be possible not to provide the energy-saving mode.

The control program executed by the image forming apparatus according to the above embodiments may be provided by being recorded in a computer-readable storage medium, such as a compact-disc read only memory (CD-ROM), a flexible disk (FD), a compact-disk recordable (CD-R), or a digital versatile disk (DVD), in a computer-installable or a computer-executable format.

The control program executed by the image forming apparatus according to the above embodiments may be stored in a computer connected to a network, such as the Internet, and provided by being downloaded via the network. The control program executed by the image forming apparatus according to the above embodiments may be provided or downloaded via a network, such as the Internet.

According to the embodiments, it is possible to provide an image forming apparatus that can reduce the power consumption.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

an image forming unit configured to form an image on a medium;

a power source switch that switches between an on-state and an off-state by a user operation;

a first control unit configured to control the image forming unit;

a power supply unit that is supplied power from an external power source when the power supply unit is connected to the external power source;

a first switching unit that switches between a conduction state and a non-conduction state, the first switching unit connecting the power supply unit and the external power source when the first switching unit is in the conduction state, and the first switching unit does not connect the power supply unit and the external power source when the first switching unit is in non-conduction state;

a capacitor that stores power used by the first switching unit;

a second switching unit that switches between a conduction state and a non-conduction state, the second switching unit connecting the power supply unit and the first control unit when the second switching unit is in the conduction state, and the second switching unit does not connect the power supply unit and the first control unit when the second switching unit is in the non-conduction state; and a second control unit that is connected to the power source switch and controls the first switching unit and the second switching unit, wherein the power supply unit charges the capacitor and supplies power to the second control unit when the first switching unit is in the conduction state and the power source switch is in the on-state, and the power supply unit supplies power to the first control unit when the second switching unit is in the conduction state.

2. The image forming apparatus according to claim 1, wherein the power source switch outputs a start signal to the second control unit, the start signal indicating the on-state and requesting to start power supply from the power supply unit, the power supply switch outputs a stop signal to the second control unit, the stop signal indicating the off-state and requesting to stop power supply from the power supply unit, and when the second control unit receives the stop signal, the second control unit causes the first switching unit to switch to the non-conduction state.

3. The image forming apparatus according to claim 1, further comprising a voltage detecting unit that detects a voltage of the capacitor, wherein the power supply unit does not supply power to the capacitor when the first switching unit is in the non-conduction state, and when the first switching unit is in the non-conduction state and the voltage of the capacitor is smaller than a reference value, the second control unit causes the first switching unit to switch to the conduction state.

4. The image forming apparatus according to claim 1, further comprising a timer wherein when the timer detects that a stop time arrives at which power supply is stopped, the second control unit causes the first switching unit to switch to the non-conduction state, and when the timer detects that a start time arrives at which power supply is started, the second control unit causes the first switching unit to switch to the conduction state.

5. The image forming apparatus according to claim 1, further comprising an illuminance detecting unit that detects illuminance of an environment, wherein when the illuminance is equal to or smaller than a predetermined value, the second control unit causes the first switching unit to switch to the non-conduction state, and when the illuminance exceeds the predetermined value, the second control unit causes the first switching unit to switch to the conduction state.

6. The image forming apparatus according to claim 1, wherein the first switching unit switches to the conduction state by using the power stored in the capacitor when the second control unit receives a first signal from the power source switch indicating the on-state.

7. The image forming apparatus according to claim 1, wherein the power supply unit supplies the power to the first control unit when the second switching unit is in the conduction state and the second switching unit receives a second signal from the second control unit indicating the conduction state.

8. The image forming apparatus according to claim 1, wherein the first switching unit switches between the conduction state to the non-conduction state depending on the on-off state of one of the power source switch, a time measured by a timer, and an illuminance of an environment detected by an illuminance detecting unit.

9. A method for supplying power to an image forming apparatus that includes an image forming unit configured to form an image on a medium, a power source switch that switches between an on-state and an off-state by a user operation, a first control unit configured to control the image forming unit, a power supply unit that is supplied power from an external power source when the power supply unit is connected to the external power source, a first switching unit that switches between a conduction state and a non-conduction state, the first switching unit connecting the power supply unit and the external power source when the first switching unit is in the conduction state, and the first switching unit does not connect the power supply unit and the external power source when the first switching unit is in the non-conduction state, a capacitor that stores power used by the first switching unit, a second switching unit that switches between a conduction state and a non-conduction state, the second switching unit connecting the power supply unit and the first control unit when the second switching unit is in the conduction state, and the second switching unit does not connect the power supply unit and the first control unit when the second switching unit is in the non-conduction state, and a second control unit that is connected to the power source switch and controls the first switching unit, the method comprising:

receiving the user operation to switch the power source switch to the on-state;

switching, by the second control unit, the first switching unit to the conduction state;

charging the capacitor and supplying power to the second control unit when the first switching unit is in the conduction state and thepower source switch is in the on-state;

switching, by the second control unit, the second switching unit to the conduction state; and supplying power to the first control unit when the second switching unit is in the conduction state.

10. A non-transitory computer-readable storage medium with an executable program stored thereon for controlling an image forming apparatus that includes an image forming unit configured to form an image on a medium to execute a method, the apparatus including a power source switch that switches between an on-state and an off-state by a user operation, a first control unit configured to control the image forming unit, a power supply unit that is supplied power from an external power source when the power supply unit is connected to the external power source, a first switching unit that switches between a conduction state and a non-conduction state, the first switching unit connecting the power supply unit and the external power source when the first switching unit is in the conduction state, and the first switching unit does not connect the power supply unit and the external power source when the first switching unit is in the non-conduction state, a capacitor that stores power used by the first switching unit, a second switching unit that switches between a conduction state and a non-conduction state, the second switching unit connecting the power supply unit and the first control unit when the second switching unit is in the conduction state, and the second switching unit does not connect the power supply unit and the first control unit when the second switching unit is in the non-conduction state, and a second control unit that is connected to the power source switch and controls the first switching unit, the method comprising:

receiving the user operation to switch the power source switch to the on-state;

switching, by the second control unit, the first switching unit to the conduction state;

charging the capacitor and supplying power to the second control unit when the first switching unit is in the conduction state and the power source switch is in the on-state;

switching, by the second control unit, the second switching unit to the conduction state; and supplying power to the first control unit when the second switching unit is in the conduction state.

* * * * *